US006593838B2

(12) United States Patent
Yue

(10) Patent No.: US 6,593,838 B2
(45) Date of Patent: Jul. 15, 2003

(54) PLANAR INDUCTOR WITH SEGMENTED CONDUCTIVE PLANE

(75) Inventor: Chik Patrik Yue, East Palo Alto, CA (US)

(73) Assignee: Atheros Communications Inc., Sunnyvale, CA (US)

( * ) Notice: Subject to any disclaimer, the term of this patent is extended or adjusted under 35 U.S.C. 154(b) by 0 days.

(21) Appl. No.: 09/745,068

(22) Filed: Dec. 19, 2000

(65) Prior Publication Data

US 2002/0074620 A1 Jun. 20, 2002

(51) Int. Cl.[7] ..... H01F 27/36
(52) U.S. Cl. ..... 336/84 C; 257/531
(58) Field of Search ..... 257/531, 528, 257/499, 277, 278, 508, 758, 659, 295, 258; 333/172, 246; 336/177, 198, 84 R, 84 C, 84 M, 87, 219, 223, 232

(56) References Cited

U.S. PATENT DOCUMENTS 5,760,456 A * 6/1998 Grzegorek et al. ..... 257/531
5,959,522 A * 9/1999 Andrews ..... 336/200
6,124,624 A * 9/2000 Van Roosmalen et al. .. 257/531
6,310,386 B1 * 10/2001 Shenoy ..... 257/531
6,310,387 B1 * 10/2001 Seefeldt et al. ..... 257/531

FOREIGN PATENT DOCUMENTS

| | | |
|---|---|---|
| EP | 0 780 853 | 6/1997 |
| JP | 356125866 A | * 10/1981 |
| WO | WO 98/50956 | 12/1998 |

OTHER PUBLICATIONS

On–Chip Spiral Inductors with Patterned Ground Shield for Si–Based RF IC's. IEEE Journal of Solid State Circuits, vol. 33 (1998), pp. 743–752.
On–Chip Spiral Inductors with Patterned Ground Shields for Si–Based RF IC's. Symposium on VLSI Circuits Digest of Technical Papers (1997), pp. 85–86.
Spiral Inductor Substrate Loss Modeling in Silicon RFICs. Microwave Journal, Mar. 1999 pp. 66–81.

* cited by examiner

*Primary Examiner*—Long Pham
*Assistant Examiner*—Dana Farahani
(74) *Attorney, Agent, or Firm*—Rosenberg, Klein & Lee

(57) ABSTRACT

An integrated circuit inductor structure has a substrate disposed below an inductor. The structure also has plural conductive segments located between the substrate and the inductor. The conductive segments connect at substantially a point below the center of the inductor. An insulating layer lies between the inductor and the conductive segments.

33 Claims, 8 Drawing Sheets

PLANAR INDUCTOR WITH SEGMENTED CONDUCTIVE PLANE

FIELD

The present invention pertains generally to integrated circuits. More particularly, the present invention relates to integrated circuits having high quality inductors with a segmented conductive plane.

BACKGROUND

Due to many considerations including cost, size and reliability, inductors have been fabricated on integrated circuits (ICs) instead of being external components which are coupled to the pins of the IC. The inductors typically have a spiral structure lying in a plane in a layer of the IC. For many applications, including radio frequency (RF) circuits, having planar inductors with a high Q (quality factor) is a significant requirement. The Q of an inductor is proportional to the magnetic energy stored in the inductor divided by the energy dissipated in the inductor in one oscillation cycle. The amount of magnetic energy stored in an inductor is directly proportional to the value of inductance of the inductor. The amount of energy dissipated in the inductor depends on resistive elements associated with the inductor.

Simply fabricating a spiral planar inductor on an IC does not result in a high Q device. FIG. 1 illustrates a cross-section of a typical spiral inductor 12 formed on an integrated circuit 10. The spiral inductor 12 is fabricated from a layer of metal formed during the integrated circuit fabrication process. The first end 14 of the spiral inductor 12 is generally connected to a circuit trace on the same layer of metal as the spiral inductor 12. The second end 16 of the spiral inductor is generally connected through a via to another circuit trace which resides on another layer of metal. The layers of metal are separated by the insulating layer 18.

FIG. 2 is an equivalent circuit depicting the spiral inductor 12 shown in FIG. 1 together with its associated parasitic capacitance, resistance, and inductance.

As stated above, the amount of power dissipated in the resistive elements associated with the inductor adversely affects the Q of the inductor. The resistive elements $R_s$, $R_{SUB}$, shown in FIG. 2, dissipate power. $R_{SUB}$ represents the resistive substrate. A voltage between inductor 12 and substrate ground 22 creates an electric field across insulation layer 18 and substrate 20. If the voltage varies, the resulting changing electric field will cause current to flow through substrate 20. The current flow through the resistive substrate represented by $R_{SUB}$ dissipates power. The losses due to $R_{SUB}$ limit the Q of an inductor.

In an attempt to improve inductor performance, R. Merrill et al. in "Optimization of high Q integrated multi-level metal CMOS," 1995 International Electron Devices Meeting and Santa Clara Valley Section 1996 Winter Half-Day Symposium, proposed placing a grounded shield or conductive plane between the inductor and the substrate. FIG. 3 illustrates a spiral inductor 12 with a conductive plane 32 between inductor 12 and substrate 20. The grounded conductive plane electrically isolates the inductor from the substrate and eliminates losses due to penetration of the inductor electric field into the substrate. However, the current flowing in the inductor generates eddy currents in the conductive plane which produce a magnetic field that opposes the magnetic field of the inductor, resulting in a reduced net magnetic field. The reduced net magnetic field reduces the effective inductance and limits the inductor Q. Thus, any gain in Q due to reducing or eliminating $R_{SUB}$ may be cancelled by the decrease in inductance due to the reduced net magnetic field.

To better control the flow of eddy currents in the conductive plane, Grzegorek et al. U.S. Pat. No. 5,760,456 proposed making the conductive plane out of plural segments which extend from the edges of the conductive plane towards the center of the planar inductive structure. FIGS. 4, 5, 6 show three different types of modifications to conductive plane 32 in which the conductive plane is located between spiral inductor 12 and substrate 20, and the conductive plane is segmented. To prevent the flow of eddy currents along the outer edges of the plane, a gap 94 is placed in one of the outer edges. The gap should be large because a small gap acts as a capacitor. At a certain frequency, the capacitor will act as a short circuit and an eddy current with flow along the perimeter of the conductive plane, resulting in a lower inductance. To have a large gap the conductive layer has to cover an area larger than the area covered by the spiral inductor. Allowing the conductive layer to cover a larger area prevents achievement of a relatively high density of devices on a chip. High densities permit economical production of reliable products among other benefits. Moreover, since the capacitance due to the gap cannot be completely eliminated, there will be a frequency beyond which the inductor has a low Q because eddy currents will flow.

As described above, existing solutions are not capable of providing the relatively high Q inductors required by many electronic circuits. Additionally, existing inductors and their corresponding conductive planes require a relatively large area of chip space. Consequently, it is desirable to provide the relatively high Q inductors required by many electronic circuits, and inductors that require a relatively small area of chip space.

SUMMARY

According to an embodiment of the invention, an integrated circuit inductor structure is described. The integrated circuit inductor structure has a substrate disposed below an inductor. The structure also has plural conductive segments located between the substrate and the inductor. The conductive segments connect at substantially a point below the center of the inductor. An insulating layer lies between the inductor and the conductive segments.

BRIEF DESCRIPTION OF THE DRAWINGS

The present invention is illustrated by way of example, and not limitation, in the figures of the accompanying drawings in which like references denote similar elements, and in which.

DETAILED DESCRIPTION

An inductor for an integrated circuit is described, where the integrated circuit includes a grounding shield or conducting plane between the inductor and the substrate . In the following description, for purposes of explanation, numerous specific details are set forth in order to provide a thorough understanding of the present invention. It will be evident, however, to one skilled in the art that the present invention may be practiced in a variety of integrated circuits, especially radio frequency (RF) circuits, without these specific details. In other instances, well known operations, steps, functions and elements are not shown in order to avoid obscuring the invention.

Parts of the description will be presented using terminology commonly employed by those skilled in the art to convey the substance of their work to others skilled in the art, such as substrate, deposition, grounding, magnetic field, electric field, eddy currents, and so forth. Also parts of the description will also be presented in terms of circuits representative of the integrated circuit inductor, using elements such as discrete inductors, resistors and capacitors. As well understood by those skilled in the art, these circuits are simply representative approximations and an integrated circuit inductor may have more than one representative circuit, depending on the degree of detail that is desired.

Various operations will be described as multiple discrete steps performed in turn in a manner that is most helpful in understanding the present invention. However, the order of description should not be construed as to imply that these operations are necessarily performed in the order that they are presented, or even order dependent. Lastly, repeated usage of the phrases "in one embodiment," "an alternative embodiment," or an "alternate embodiment" does not necessarily refer to the same embodiment, although it may.

Figure 1:
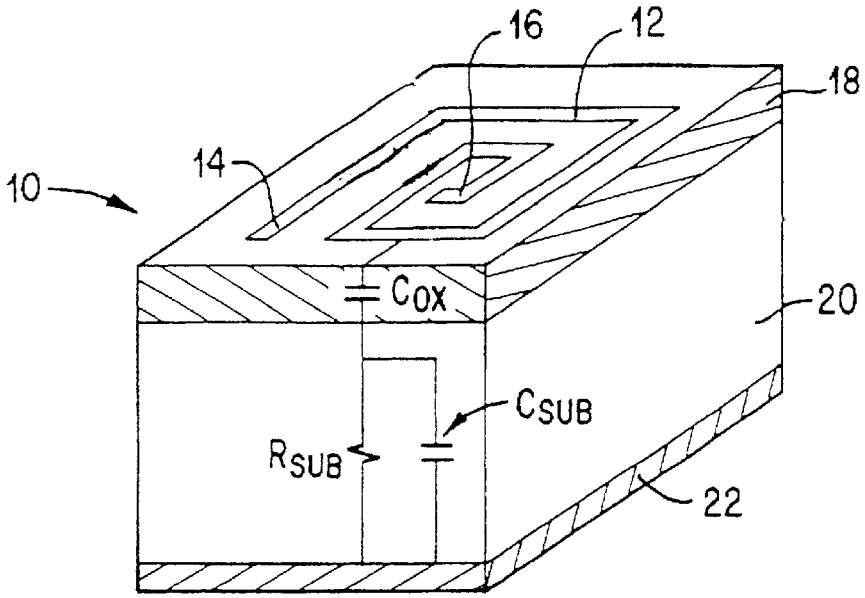
FIG. 1 PRIOR ART
FIG. 1 illustrates a cross-section of a typical spiral inductor formed on an integrated circuit.
Figure 2:
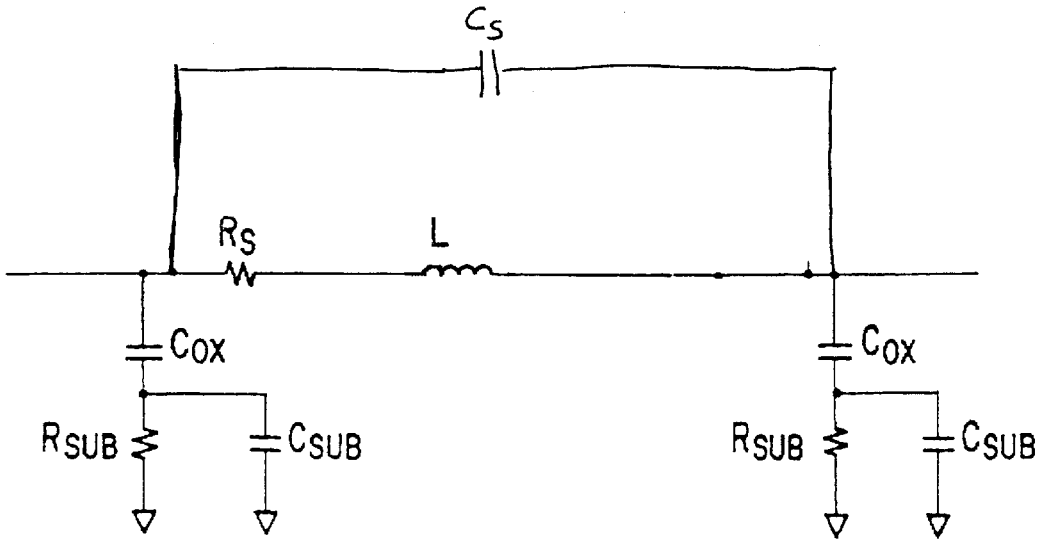
FIG. 2 PRIOR ART
FIG. 2 illustrates an equivalent circuit of the planar spiral inductor of FIG. 1 and its parasitic circuit elements.
Figure 3:
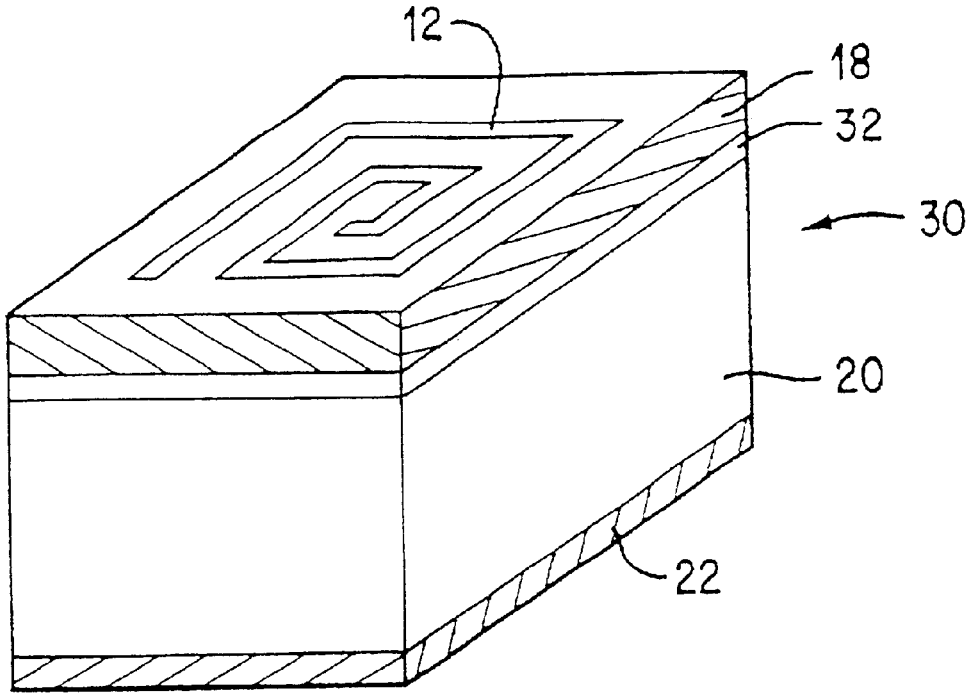
FIG. 3 PRIOR ART
FIG. 3 illustrates a cross section perspective of a planar spiral inductor and a conductive plane between the substrate and the inductor.
Figure 4:
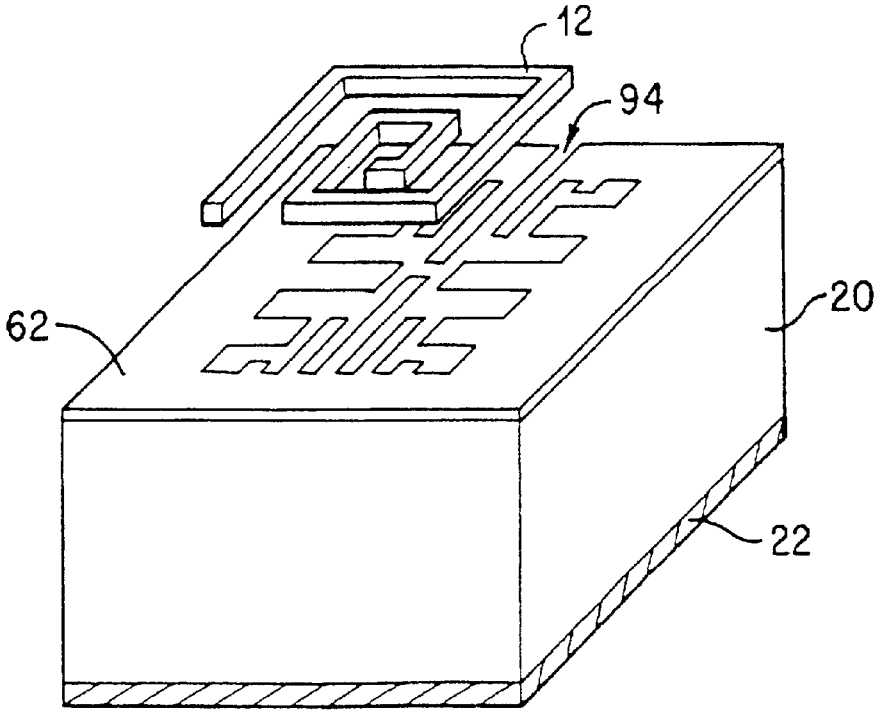
FIG. 4 PRIOR ART
FIG. 4 illustrate a cross section view of an inductor and a conductive shield that is segmented.
Figure 5:
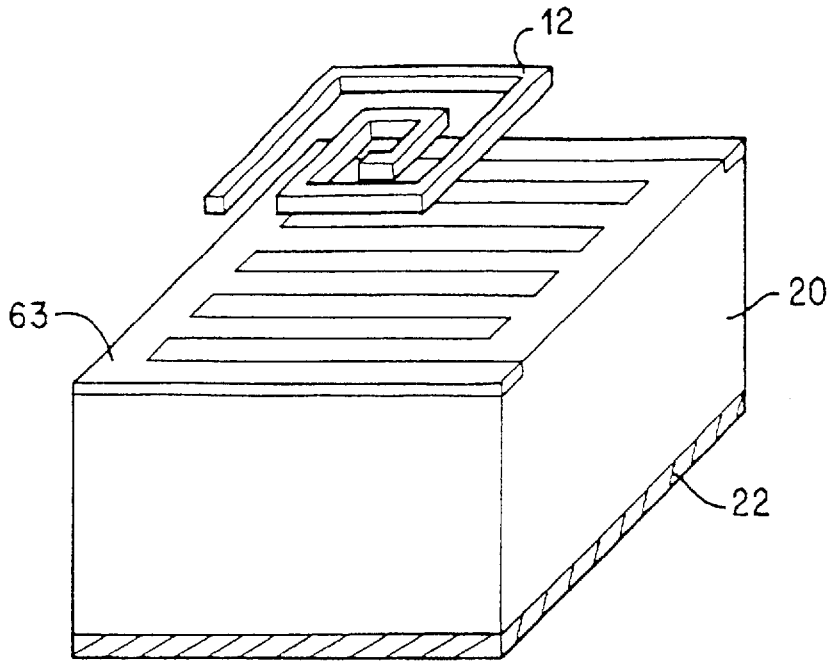
FIG. 5 PRIOR ART
FIG. 5 illustrates a cross section view of another inductor and a conductive shield that is segmented.
Figure 6:
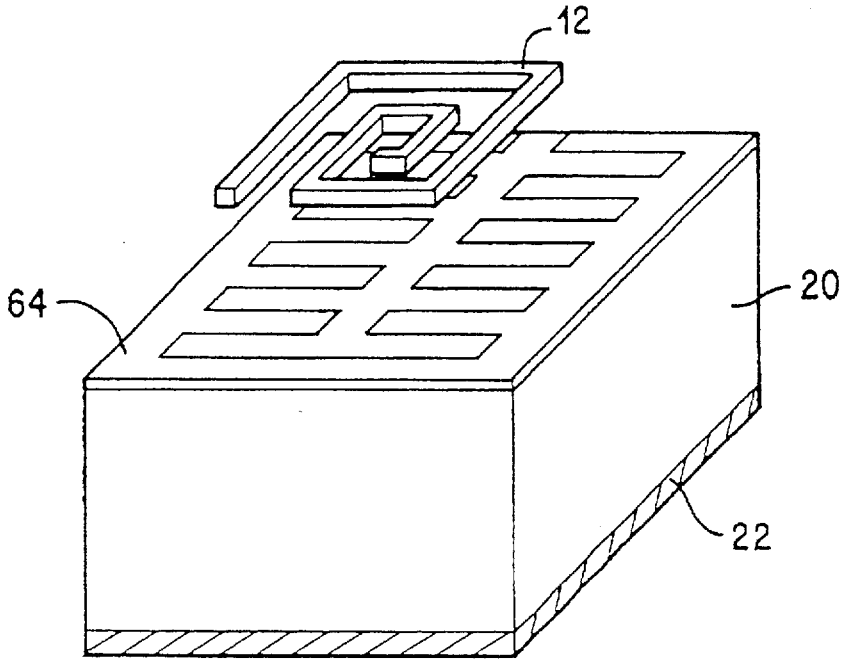
FIG. 6 PRIOR ART
FIG. 6 illustrates a cross section view of another inductor and a conductive shield that is segmented.
Figure 7:
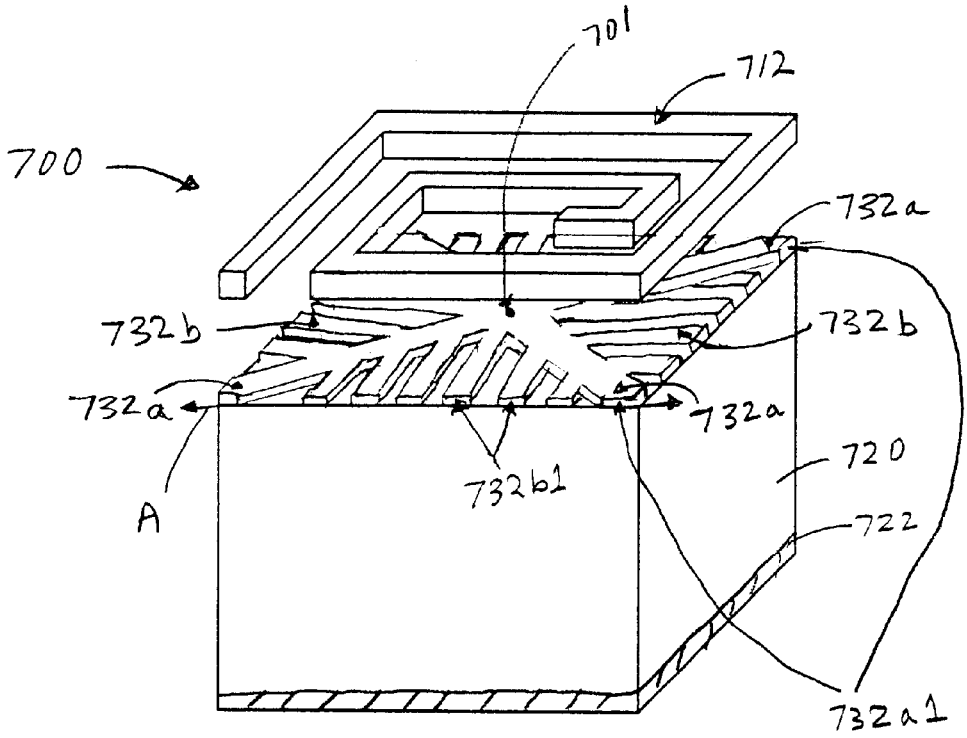
FIG. 7 illustrates a cross section view of an inductor and a conductive shield comprising multiple conductive segments according to an embodiment of this invention.

FIG. 7 illustrates a cross section view of an inductor and a conductive shield comprising multiple conductive segments according to an embodiment of this invention. Integrated circuit 700 includes conductive segments 732*a*, inductor 712, filaments 732*b*, substrate 720, and ground layer 722. Conductive segments 732*a* emanate from substantially a point 701 below the center of inductor 712. Conductive segments 732*a* can be polysilicon, diffusion regions in substrate 720, copper, aluminum, or another metal. Filaments 732*b* can be made from the same material as the conductive segments or another material. For example, the conductive segments can be metal and the filaments can be polysilicon.

Figure 8:
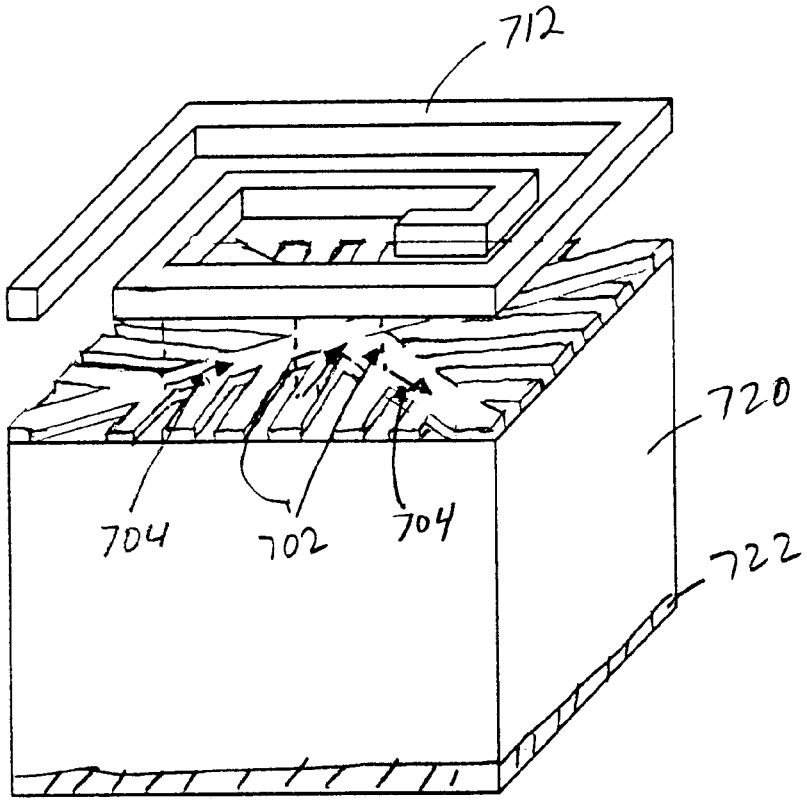
FIG. 8 illustrates electric field lines and currents in a conductive shield in accordance with one embodiment of the present invention.

Since the ends 732*a*1 of conductive segments 732*a* do not intersect and the ends 732*b*1 of filaments 732*b* do not intersect, there are no closed loops through which an eddy current can flow. FIG. 8 illustrates electric field lines and currents in a conductive shield in accordance with one embodiment of the present invention. Electric field lines 702 emanating from the spiral inductor will terminate at the conductive segments 732*a* or the filaments 732*b*. Current 704 flows from the termination points of the electric field lines to a low impedance reference voltage electrically connected to a conductive segment.

Additionally, since ends 732*a*1 do not intersect and ends 732*b*1 do not intersect there is no need to make conductive segments 732*a* and filaments 732*b* extend substantially beyond the area directly below inductor 712. Consequently, for a given area taken up by an inductor trace, the area taken up by the conductive segments and the filaments of the present invention is smaller than the area required by prior art segmented conductive shields. Some prior art segmented conductive shields have a gap in a perimeter region. In order for the gap to be large, the perimeter region is disposed in an area that is not directly below the inductor. Thus, the area required by the inductor structure is the larger area taken up by the conductive shield, and not the area required by the inductor trace. Similarly, some prior art segmented shields had a continuous perimeter region in which an eddy current could flow if the perimeter region was substantially directly below the inductor trace. Since eddy currents are undesirable, the perimeter region was enlarged so that it was not substantially directly below the inductor trace, making the area taken up by the conductive shield appreciably larger than the area taken up by the inductor trace.

Figure 9A:
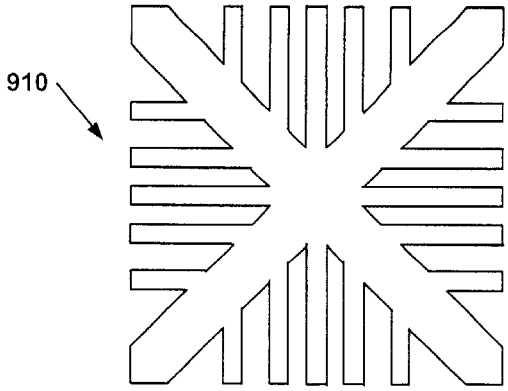
FIG. 9*a* illustrates a pattern for a conductive shield having segments and filaments according to one embodiment of the present invention.
Figure 9B:
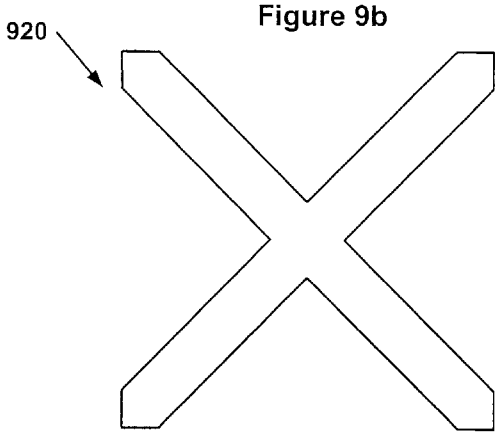
FIG. 9*b* illustrates a pattern for conductive segments of a conductive shield.
Figure 9C:
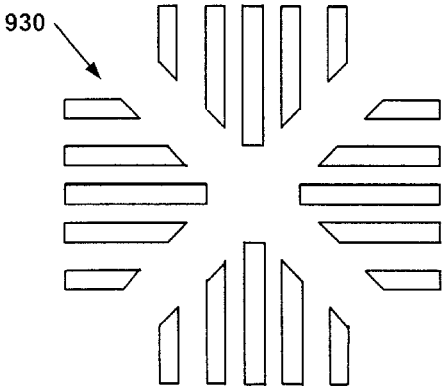
FIG. 9*c* illustrates a pattern for filaments of a conductive shield.
Figure 9D:
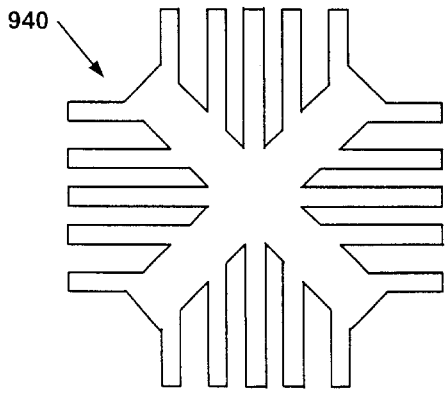
FIG. 9*d* illustrates a pattern for filaments that lie in a layer different from the layer in which the conductive segments lie.

FIG. 9*a* illustrates a pattern for a conductive shield having segments and filaments according to one embodiment of the present invention. Pattern 910 can be used when the segments and filaments of a conductive shield lie in one plane or layer of an integrated circuit and are made of the same material. FIG. 9*b* illustrates a pattern for segments of a conductive shield. FIGS. 9*c* and 9*d* illustrates a pattern for filaments of a conductive shield. Patterns 920 along with 930 or 940 can be used when the segments and filaments are made of different materials. In other words, pattern 920 along with 930 and 940 can be used to make a conductive shield which has conductive segments in one layer and filaments in another layer of an integrated circuit.

Figure 10:
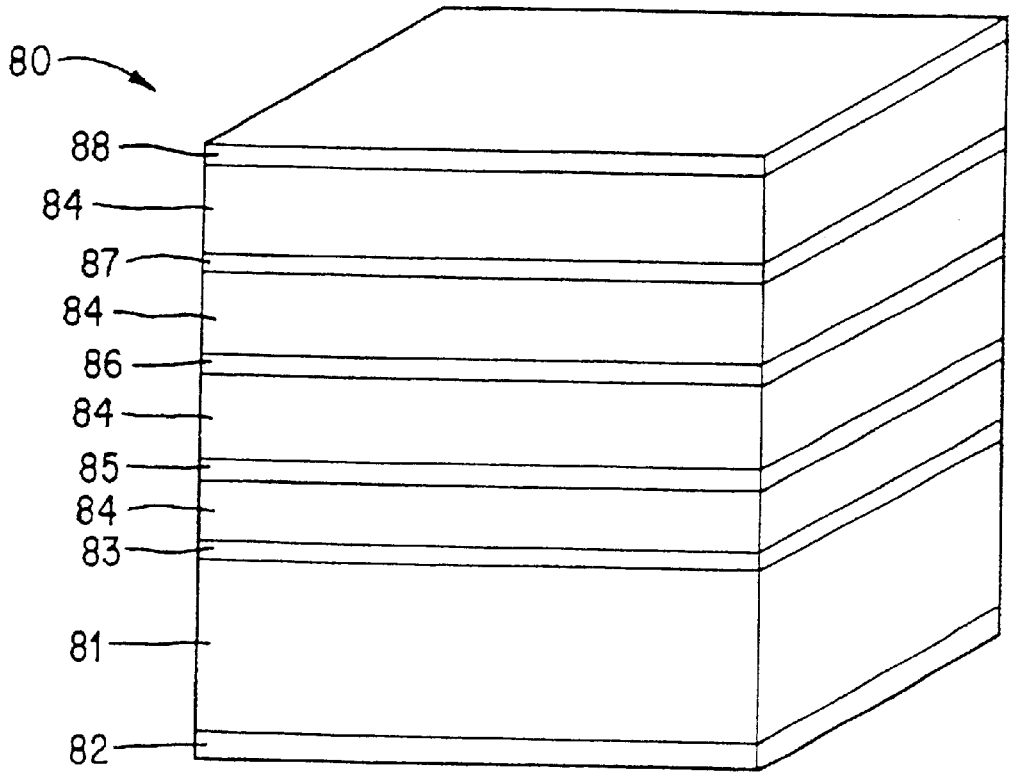
FIG. 10 shows a cross-section perspective view of a typical integrated circuit structure 80 in which a spiral inductor and conductive shield may be fabricated

FIG. 10 shows a cross-section perspective view of a typical integrated circuit structure 80 in which a spiral inductor and conductive shield may be fabricated. The structure includes a resistive substrate 81 with a conductive layer 82 on its bottom surface. On the top surface of the resistive substrate 81 exists doping region layer 83 which is conductive and can be formed by heavily doping the top surface of resistive substrate 81. The segmented conductive plane can be fabricated out of doping region layer 83 by selectively doping the top surface of resistive substrate 18 to provide the desired shape of the segmented conductive plane. For example, pattern 910 can be used to create both the conductive segments and the filaments of the conductive plane. Alternatively, pattern 930 or 940 can be used to create filaments in doping region 83, and pattern 920 can be used to create conductive segments in a layer above region 83 as described below.

The processes used to selectively dope the top surface of resistive substrate 81 to fabricate the segmented conductive plane are the same processes used to selectively dope the top surface of the resistive substrate 81 when fabricating active and passive semiconductor devices such as transistors, diodes and resistors. The fabrication of active and passive devices on a resistive substrate is a process that is well understood and is a processing step in the fabrication of essentially all integrated circuits.

Above the doping region 83 is first insulating layer 84. Insulating layer 84 may include a non-conductive oxide. Above first insulating layer 84 is polysilicon layer 85. The conductive plane can be formed in polysilicon layer 85 by masking and etching polysilicon layer 85 as the polysilicon layer is fabricated. For example, pattern 910 can be used to create both the conductive segments and the filaments of the conductive plane in layer 85. Alternatively, pattern 930 or 940 can be used to create filaments in doping region 83, and pattern 920 can be used to create conductive segments in layer 85 or a layer above layer 85. A via can be used to connect the filaments in region 83 with the conductive segments in layer 85.

Above the polysilicon layer is another insulating layer 84. The next layer is a first metalization layer 86. The segmented conductive plane can be formed in the first metalization layer 86 by masking the first metalization layer 86 after it is formed with a photoresist. The metalization layer 86 with photoresist is exposed to light and then etched to form the patterns. This procedure is the same as is presently used to form patterns in metalization layers when creating the electrical interconnections between devices on an integrated circuit. The conductive plane can alternatively be formed by selectively depositing the first metalization layer 86 in the desired pattern. For example, pattern 910 can be used to create both the conductive segments and the filaments of the conductive plane in layer 86. Alternatively, pattern 930 or 940 can be used to create filaments in a layer below layer 86, and pattern 920 can be used to create conductive segments in layer 86 or a layer above layer 86. A via can be used to connect the filaments and the conductive segments.

Above the first metalization layer 86 is another insulating layer 84. The next layer is a second metalization layer 87. The second metalization layer 87 can be used to form a connection trace to one end of the spiral inductor. Above the second metalization layer is another insulating layer 84. The top layer is a third metalization layer 88 in which a spiral inductor 12 can be formed.

A conductive plane can be formed in one of the following: doping region layer 83, polysilicon layer 85, or first metalization layer 86. Alternatively, the conductive plane can be formed in more than layer as described above. Specifically, the conductive segments of the conductive plane can be in one layer and the filaments can be another layer. The closer the conductive plane is formed to the spiral inductor, the more parasitic capacitance there is associated with the spiral inductor. Typically, the doping region layer 83 is the layer that is the farthest from the spiral inductor. However, the doping region layer 83 is more resistive than the metalization layer 86 or the polysilicon layer 85 depending on the IC technology employed. The polysilicon layer 85 is more resistive than the metalization layer 86. As the resistivity of the segmented conductive plane increases, the electrostatic shielding that the segmented conductive plane provides becomes less effective and the electric field loss increases. Electric field loss translates into a reduction in the Q of the spiral inductor. Therefore, a tradeoff exists between spiral inductor loss and spiral inductor capacitance depending on the layer selected as the segmented conductive plane and the distance between the spiral inductor and the segmented conductive plane.

Inductors are typically implemented using the top 2 metal layers, for these metal layers have the lowest capacitance to the shield and the substrate. In the example above, the IC described has 3 metal layers; therefore, it is most beneficial to build the inductor using the second and third metal layers. In some advanced IC technologies, in excess of 5 metal layers are available. When implementing inductors in these technologies, one would choose to use the top-most metal layers to achieve the lowest parasitic capacitance.

Thus, an integrated circuit inductor with a conductive plane between the inductor and the substrate has been described. Although the present invention has been described with reference to specific exemplary embodiments, it will be evident to one of ordinary skill in the art that various modifications and changes may be made to these embodiments without departing from the broader spirit and scope of the invention as set forth in the claims. Accordingly, the specification and drawings are to be regarded in an illustrative rather than a restrictive sense.

I claim:

1. An integrated circuit inductor structure comprising;

a substrate;

an inductor;

plural conductive segments located between the substrate and the inductor, the conductive segments connecting at a point substantially below a center of the inductor and extending radially outward therefrom in angularly spaced manner, the conductive segments terminating at respective free ends to be isolated one from the other thereat; and an insulating layer lying between the inductor and the conductive segment.

2. The inductor structure of claim 1, further comprising plural filaments emanating from the plural conductive segments.

3. The inductor structure of claim 1, further comprising multiple layers between the inductor and the substrate and wherein the plural conductive segments are at least one layer below the inductor.

4. The inductor structure of claim 1, further comprising:

multiple layers between the inductor and the substrate;

plural filaments at least one layer below the plural conductive segments; and wherein the plural conductive segments are at least one layer below the inductor, and the plural filaments are coupled to the plural conductive segments.

5. The inductor structure of claim 1, wherein the plural conductive segments are metal.

6. The inductor structure of claim 1, wherein the plural conductive segments are polysilicon.

7. The inductor structure of claim 1, wherein the plural conductive segments comprise a diffusion layer in the substrate.

8. The inductor structure of claim 1, wherein only one of the plural conductive segments is coupled to a fixed low impedance potential.

9. An integrated circuit inductor structure comprising:

a substrate;

an inductor;

plural conductive segments located between the substrate and the inductor, the conductive segments being arranged to allow minimal eddy currents to flow only at a point substantially below a center of the inductor, the conductive segments extending radially outward from the point in angularly spaced manner, the conductive segments terminating at respective free ends to be isolated one from the other thereat; and an insulating layer lying between the inductor and the conductive segments.

10. The inductor structure of claim 9, further comprising plural filaments emanating from the plural conductive segments.

11. The inductor structure of claim 9, further comprising multiple layers between the inductor and the substrate and wherein the plural conductive segments are at least one layer below the inductor.

12. The inductor structure of claim 9, further comprising:

multiple layers between the inductor and the substrate;

plural filaments at least one layer below the plural conductive segments; and wherein the plural conductive segments are at least one layer below the inductor, and the plural filaments are coupled to the plural conductive segments.

13. The inductor structure of claim 9, wherein the plural conductive segments are metal.

14. The inductor structure of claim 9, wherein the plural conductive segments are polysilicon.

15. The inductor structure of claim 9, wherein the plural conductive segments comprise a diffusion layer in the substrate.

16. The inductor structure of claim 9, wherein only one of the plural conductive segments is coupled to a fixed low impedance potential.

17. An integrated circuit inductor structure comprising:

a substrate;

an inductor lying above the substrate;

plural conductive segments that emanate radially outward from a point below the inductor in angularly spaced manner, the conductive segments lying above the substrate, the conductive segments terminating at respective free ends to be isolated one from the other thereat; and an insulating layer lying between the inductor and the conductive segments.

18. A method of increasing the Q of an integrated circuit inductor, the method comprising the steps of;

providing a substrate;

placing in a plane above the substrate plural conductive segments that emanate radially outward from a point above the substrate in angularly spaced manner, the conductive segments terminating at respective free ends to be isolated one from the other thereat;

placing an insulating layer above the plural conductive segments;

placing an inductor above the plural conductive segments such that a center of the inductor is above the point above the substrate.

19. The method of claim 18, further comprising placing plural filaments coupled to the conductive segments.

20. The method of claim 18, further comprising placing plural filaments at least one layer below the conductive segments, and wherein the plural filaments are coupled to the conductive segments.

21. An integrated circuit inductor structure comprising:

a substrate;

an inductor;

plural conductive segments located between the substrate and the inductor, the conductive segments connecting at a point substantially below a center of the inductor and extending radially outward therefrom in angularly spaced manner, the conductive segments terminating at respective free ends to be isolated one from the other thereat;

plural filaments emanating from the plural conductive segments; and an insulating layer lying between the inductor and the conductive segments.

22. The inductor structure of claim 21, wherein each of the plural filaments have a respective end away from the plural conductive segment from which the plural filament emanates.

23. The inductor structure of claim 22, wherein each respective end is electrically isolated from the other respective ends so that the filaments are not included within any closed loops through which an eddy current can flow.

24. The inductor structure of claim 21, wherein the plural conductive segments and the plural filaments provide electrical shielding for the substrate from the inductor.

25. An integrated circuit inductor structure comprising:

a substrate;

an inductor;

multiple layers between the inductor and substrate;

plural conductive segments located between the substrate arid the inductor at least one layer below the inductor, the conductive segments connecting at a point substantially below a center of the inductor and extending radially outward therefrom in angularly spaced manner, the conductive segments terminating at respective free ends to be isolated one from the other thereat;

plural filaments located between the substrate and inductor at least one layer below the plural conductive segments and coupled to the plural conductive segments; and an insulating layer lying between the inductor and the conductive segments.

26. The inductor structure of claim 25, wherein the plural filaments are made from a different material than the plural conductive segments.

27. The inductor structure of claim 26, wherein the plural conductive segments are metal and the plural filaments are polysilicon.

28. An integrated circuit inductor structure comprising:

a substrate;

an inductor;

plural conductive segments located between the substrate and the inductor, the conductive segments connecting at a point substantially below a center of the inductor and extending radially outward therefrom in angularly spaced manner, the conductive segments terminating at respective free ends to be isolated one from the other thereat, wherein only one of the plural conductive segments is coupled to a fixed low impedance potential; and an insulating layer lying between the inductor and the conductive segments.

29. The inductor structure of claim 1, wherein the plural conductive segments do not extend substantially beyond an area directly below and corresponding to an inductor area taken up by the inductor.

30. The inductor structure of claim 9, wherein the plural conductive segments do not extend substantially beyond an area directly below and corresponding to an inductor area taken up by the inductor.

31. The inductor structure of claim 9, wherein the plural conductive segments are not included within any closed loops through which an eddy current can flow.

32. The inductor structure of claim 9, wherein the plural conductive segments connect at the point.

33. The inductor structure of claim 32, wherein each of the plural conductive segments has a respective end away from the point, wherein each respective end does not intersect with, and is not directly or indirectly coupled to, any of the other respective ends.

* * * * *